US012735888B2

(12) United States Patent
Wright

(10) Patent No.: US 12,735,888 B2
(45) Date of Patent: Sep. 15, 2026

(54) WALL FRAMING BRACKET AND ASSEMBLY

(71) Applicants: ETEX AUSTRALIA PTY LTD, Matraville (AU); ETEX BUILDING PERFORMANCE INTERNATIONAL SAS, Avignon (FR)

(72) Inventor: Benjamin Neil Wright, Matraville (AU)

(73) Assignees: Etex Australia PTY LTD, Matraville (AU); Etex Building Performance International SAS, Avignon (FR)

( * ) Notice: Subject to any disclaimer, the term of this patent is extended or adjusted under 35 U.S.C. 154(b) by 416 days.

(21) Appl. No.: 18/285,272

(22) PCT Filed: Apr. 15, 2022

(86) PCT No.: PCT/EP2022/060167
§ 371 (c)(1),
(2) Date: Oct. 2, 2023

(87) PCT Pub. No.: WO2022/219178
PCT Pub. Date: Oct. 20, 2022

(65) Prior Publication Data

US 2024/0175254 A1 May 30, 2024

(30) Foreign Application Priority Data

Apr. 16, 2021 (AU) ..... 2021202304

(51) Int. Cl.
*E04B 1/38* (2006.01)
*E04C 3/02* (2006.01)

(52) U.S. Cl.
CPC ..... *E04B 1/388* (2023.08); *E04C 3/02* (2013.01); *E04B 2001/389* (2023.08)

(58) Field of Classification Search
CPC ..... E04B 1/388; E04B 2001/389; E04C 3/02
USPC ..... 52/204.1
See application file for complete search history.

(56) References Cited

U.S. PATENT DOCUMENTS 1,441,559 A 1/1923 Burhen
4,054,392 A * 10/1977 Oppenheim ..... F16B 7/18 403/189
4,235,559 A * 11/1980 Rooklyn ..... F16B 12/30 403/171
D311,859 S * 11/1990 Bohringer ..... D8/380
5,547,169 A * 8/1996 Russell ..... E04H 17/1439 256/65.05

(Continued)

FOREIGN PATENT DOCUMENTS

NL 1015705 C2 1/2002

*Primary Examiner* — James J Buckle, Jr.
(74) *Attorney, Agent, or Firm* — Dilworth & Barrese, LLP.; Michael J. Musella, Esq.

(57) ABSTRACT

Wall framing bracket (10) for securing a header (12) to a stud (14). The bracket (10) includes aback-plate (16) configured to be secured to the stud (14), and opposed sides (18, 20) extending from the back-plate (16). The sides (18, 20) are spaced apart to allow arranging against, and fixing to, opposed surfaces (22, 24) of the header (12). One of the sides (18) defines an opening (26) to allow access to the other side (20) to secure one or more fasteners (28) therethrough and into the header (12). Wall framing assembly (100) including the bracket (10) is also disclosed.

18 Claims, 5 Drawing Sheets

(56) References Cited

U.S. PATENT DOCUMENTS

D378,986 S * 4/1997 Darula ..... D8/354
D387,970 S * 12/1997 Enslen ..... D8/349
5,695,174 A * 12/1997 Tsai ..... E04H 17/143 256/22
6,398,193 B1 * 6/2002 DeSouza ..... E04H 17/1488 256/65.06
6,609,344 B2 * 8/2003 Saldana ..... E04B 5/14 52/696
6,799,408 B2 * 10/2004 Brady ..... E06B 1/6092 52/210
D557,117 S * 12/2007 Cannaverde ..... D8/354
D558,041 S * 12/2007 Skinner ..... D8/382
7,762,038 B2 * 7/2010 Ceba ..... E04B 1/2403 52/655.1
D654,350 S * 2/2012 Preda ..... D8/354
D667,718 S * 9/2012 Preda ..... D8/354
8,484,927 B2 * 7/2013 Nguyen ..... E04B 7/063 52/715
8,540,201 B2 * 9/2013 Gadd ..... E04B 1/2612 52/715
8,615,942 B2 * 12/2013 Lafreniere ..... E04B 2/766 52/715
8,863,438 B1 * 10/2014 Seitz ..... E06B 3/01 52/655.1
D758,968 S * 6/2016 El Zakhem ..... D13/122
D800,536 S * 10/2017 Kelley ..... D8/354
D823,674 S * 7/2018 Ng ..... D8/380
10,017,983 B1 * 7/2018 McSparrin ..... E06B 9/42
D849,507 S * 5/2019 DeDios-Shirley ..... D8/349
D904,172 S * 12/2020 Jenkins ..... D8/354
D919,413 S * 5/2021 Eveland ..... D13/102
D924,673 S * 7/2021 Bean ..... D8/382
11,118,358 B2 * 9/2021 Hatzinikolas ..... E04F 13/0857
11,236,503 B2 * 2/2022 Fox ..... E04B 1/2604
D946,570 S * 3/2022 Ded ..... D14/349
D997,075 S * 8/2023 Donelson ..... D12/407
D1,000,254 S * 10/2023 Nonah ..... D8/354
D1,030,457 S * 6/2024 Hunsaker ..... D8/363
2003/0155474 A1 * 8/2003 Dean ..... G11B 33/124 248/300
2006/0096201 A1 * 5/2006 Daudet ..... E04C 3/07 52/272
2007/0044417 A1 * 3/2007 Surowiecki ..... E04B 2/7457 52/653.1
2010/0031600 A1 * 2/2010 Nakagawa ..... E04B 1/24 52/653.1
2013/0247483 A1 * 9/2013 Hohmann, Jr. ..... E04B 1/4178 52/707
2016/0305113 A1 * 10/2016 Hatzinikolas ..... E04F 13/0801
2018/0094423 A1 * 4/2018 Getz ..... E04B 9/127
2018/0209150 A1 * 7/2018 Diamond ..... E04D 3/3608
2019/0194930 A1 * 6/2019 Stevens ..... E06B 1/18

* cited by examiner

WALL FRAMING BRACKET AND ASSEMBLY

TECHNICAL FIELD

The present disclosure relates generally to wall framing used to construct interior or exterior walls of buildings.

BACKGROUND

Framing is commonly used to construct interior and exterior walls of buildings. A wall frame is formed from timber or metal frame members and usually includes a plurality of vertically arranged studs connected between spaced top and bottom plates. For interior walls, drywall (also known as plasterboard) panels are secured to the studs.

A wall frame may define an opening for a window or door. Such openings include a header arranged horizontally between studs across a top of the opening. The header is typically secured to the studs by brackets and fasteners. Header brackets are generally configured as C-section bent sheet metal structures dimensioned to fit to opposed, parallel internal or external surfaces of the header. Assembling the header to the stud involves securing the bracket to the stud, arranging the header within, or around, the bracket, and securing fasteners through opposed top and bottom surfaces of the header and bracket.

An increasingly common approach to constructing doorways is to install a prefabricated door frame. This is secured within an opening defined by a pair of studs and a header of a wall frame. Using prefabricated door frames can provide various technical advantages. However, when installed, the door frame inhibits or prevents access to an underside of the header, which can complicate assembling the header to the studs.

Any discussion of documents, acts, materials, devices, articles or the like which has been included in the present specification is not to be taken as an admission that any or all of these matters were common general knowledge in the field relevant to the present disclosure as it existed before the priority date of each of the appended claims.

SUMMARY

According to one aspect of the disclosure, there is provided a wall framing bracket for securing a header perpendicularly to a stud, the bracket including: a back-plate configured to be secured to the stud; and opposed sides extending from the back-plate, the sides spaced apart to allow arranging against, and fixing to, opposed surfaces of the header, wherein one of the sides defines an opening to allow access to the other side to secure one or more fasteners therethrough and into the header.

The opening may be defined between a pair of spaced tabs.

The back-plate may define a plurality of apertures, each aperture configured to receive a fastener to allow securing the bracket to the stud.

At least one of the sides may define a further plurality of apertures, each further aperture configured to receive a fastener to allow securing the bracket to the header.

The side accessible through the opening may define a width dimensioned to be less than a width defined by the back-plate. The width defined by the back-plate may be dimensioned to be substantially equal to a width defined by the stud. The side defining the opening may define a width dimensioned to be equal to the width defined by the back-plate.

According to another aspect of the disclosure, there is provided a wall framing assembly including: a stud; a bracket according to any of the preceding paragraphs; and a header having opposed sides and defining an elongate slit extending along a length of one of the sides, the slit dimensioned to be equal to, or greater than, the opening of the bracket to allow access through the opening.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

It will be appreciated embodiments may comprise steps, features and/or integers disclosed herein or indicated in the specification of this application individually or collectively, and any and all combinations of two or more of said steps or features.

BRIEF DESCRIPTION OF DRAWINGS

Embodiments will now be described by way of example only with reference to the accompany drawings in which.

DESCRIPTION OF EMBODIMENTS

Figure 4:
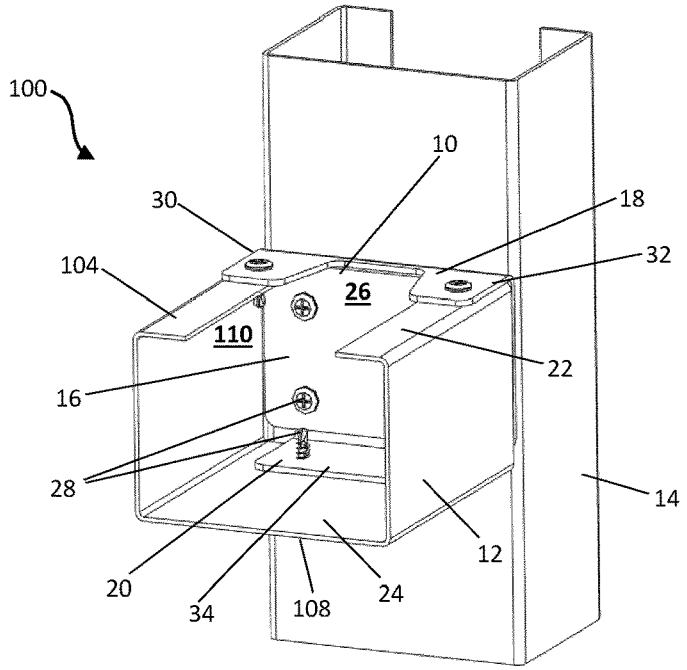
FIGS. 4 and 5 are two isometric views of a wall framing assembly including the bracket shown in the previous figures.

In the drawings, reference numeral 10 generally designates a wall framing bracket 10 for securing a header 12 (FIG. 4) perpendicularly to a stud 14 (FIG. 4). The bracket 10 includes a back-plate 16 configured to be secured to the stud 14, and opposed sides 18, 20 extending from the back-plate 16. The sides 18, 20 are spaced apart to allow arranging against, and fixing to, opposed surfaces 22, 24 (FIG. 4) of the header 12. One of the sides 18 defines an opening 26 to allow access to the other side 20 to secure one or more fasteners 28 (FIG. 4) therethrough and into the header 12.

Figure 1:
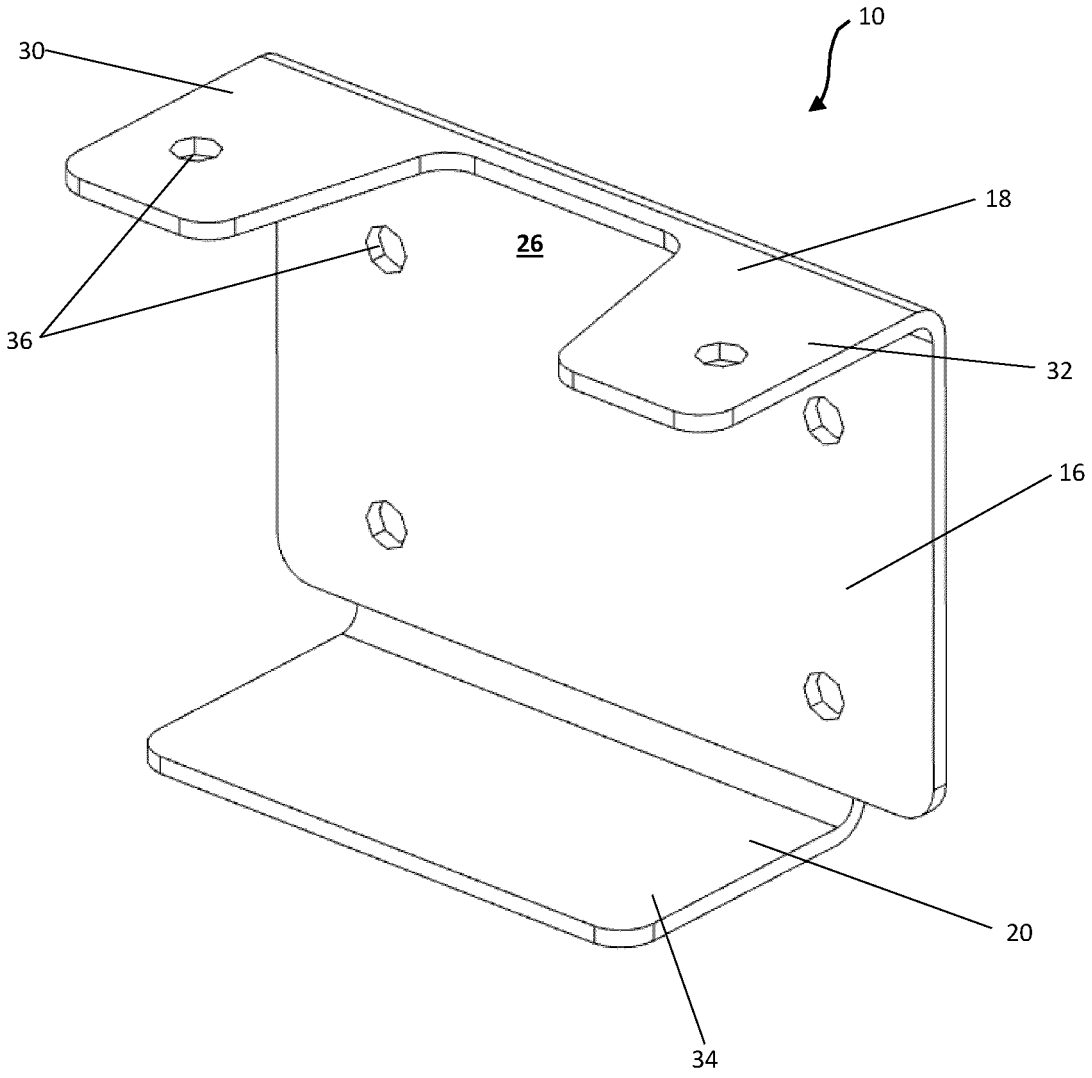
FIG. 1 is an isometric view of a wall framing bracket.
Figure 2:
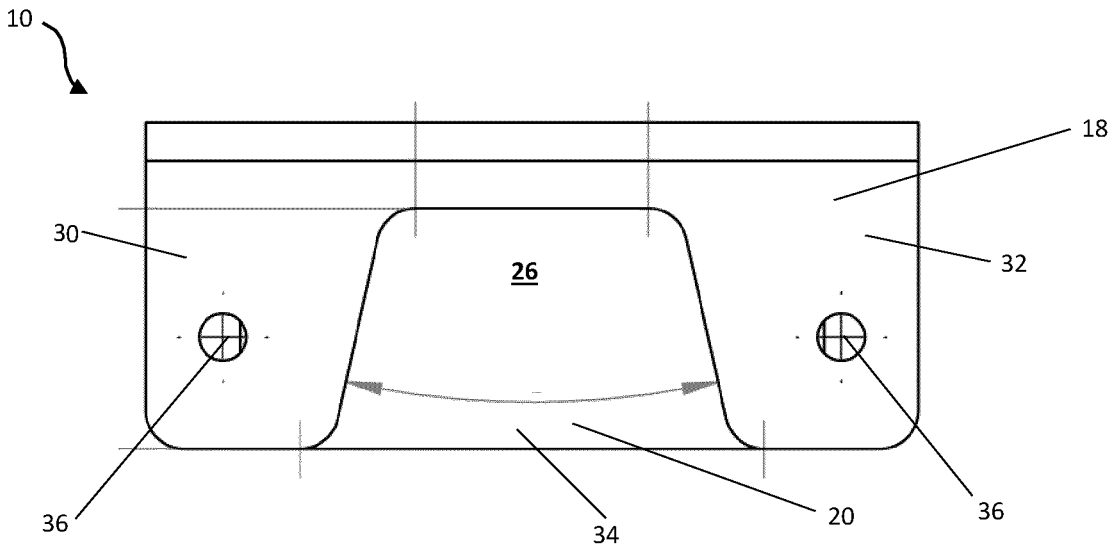
FIGS. 2 and 3 are top and front views, respectively, of the bracket shown in FIG. 1.
Figure 3:
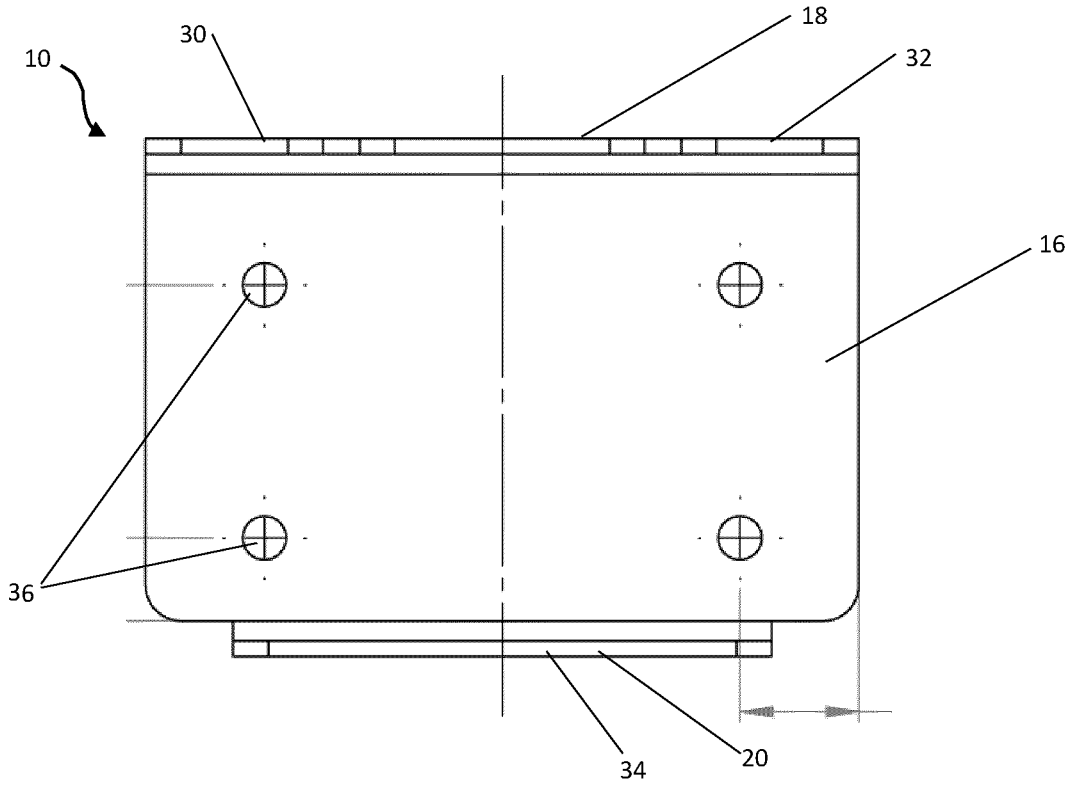

FIGS. 1 to 3 illustrate the bracket 10 in isolation. Best shown in FIG. 1, the side 18 defining the opening 26 is an operatively top side 18 and the side 20 accessible through the opening 26 is an operatively bottom side 20. The back-plate 16 is configured as a planar panel and each side 18, 20 is configured to extend perpendicularly to the back-plate 16. In the illustrated embodiment, the bracket 10 is formed from bent sheet metal. In other embodiments (not shown), the bracket 10 is formed from one or more plastic mouldings, or a cast structure.

The top side 18 includes a pair of spaced tabs 30, 32. Each tab 30, 32 extends perpendicularly to the back-plate 16 to define the opening 26 between the tabs 30, 32. Best shown in FIG. 2, the opening 26 is defined by a U-shaped slot cut through the top side 18 to form the flanking tabs 30, 32. In other embodiments (not shown), the tabs 30, 32 extend directly from the back-plate 16. In yet other embodiments (now shown), the opening 26 is defined by one or more apertures extending through the top side 18.

The top side 18 is a continuation of the back-plate 16, defined by a bend of the sheet metal, and defines the same width as the back-plate 16. In other embodiments (not shown), the side 18, or the tabs 30, 32, are configured to be spaced inwardly within the width of the back-plate 16.

Figure 5:
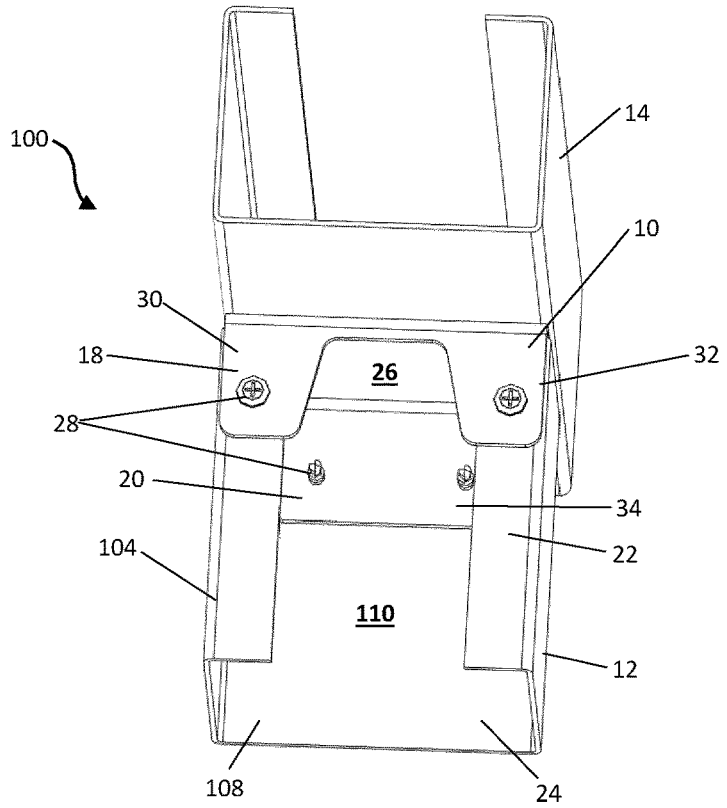

The bottom side 20 is configured to optimise surface area available for fixing fasteners into within the space limitations defined by the installation environment. In the illustrated embodiment, the bottom side 20 includes a further tab 34 extending perpendicularly to the back-plate 16. Best shown in FIG. 3, the back-plate 16 defines a width dimensioned to be substantially equal to a width of the stud 14. The tab 34 defines a width which is less than the width of the back-plate 16 such that the tab 34 defines opposed side-walls spaced in-board of the back-plate 16. Dimensioning the tab 34 in this way allows fitting the tab 34 within an internal region of the header 12, as shown in FIGS. 4 and 5. In other embodiments (not shown), the bottom side 20 is a continuation of the back-plate 16, defined by a bend of the sheet metal, and defines the same width as the back-plate 16.

In the illustrated embodiment, the back-plate 16 and the top side 18 define a plurality of apertures 36, each dimensioned to receive a fastener 28. The bottom side 20 does not define any apertures, instead forming a continuous plate to allow fixing fasteners through the bottom side 20 from operatively above, such as when fixing the bracket 10 above a door frame, or from operatively below, such as when fixing the bracket 10 above a window frame.

Figure 7:
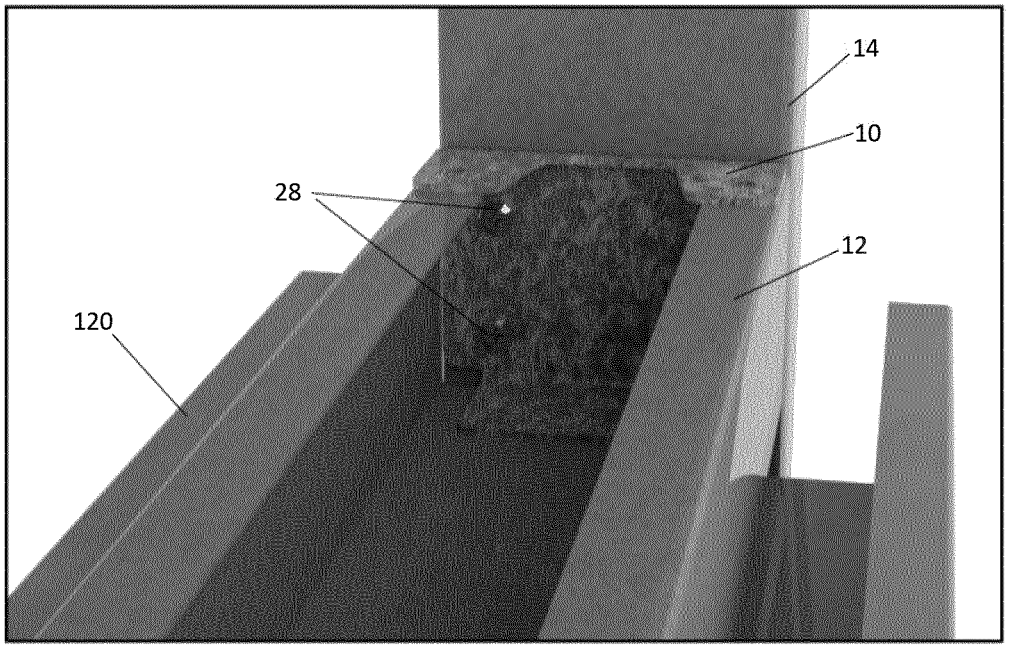

FIGS. 4 and 5 illustrate a wall framing assembly 100 including the stud 14, the bracket 10 and the header 12. In this embodiment, each of the stud 12 and the header 12 are bent sheet metal structures defining a hollow internal region. The back-plate 16 of the bracket 10 is secured to the stud 14 by a plurality of the fasteners 28, typically being screws although it will be appreciated that other mechanical fasteners, such as rivets, may be appropriate. The tabs 30, 32 of the top side 18 of the bracket 10 are each secured by fasteners 28 to an external surface 22 of an upper side 104 of the header 12. The tab 34 of the bottom side 20 of the bracket 10 is secured by further fasteners 28 to an internal surface 24 of a lower side 108 of the header 12. In FIGS. 4 and 5, the fasteners 28 through the bottom side 16 and lower side 108 are shown extending upwards, into the hollow region of the header 12. This arrangement is typically used where the header 12 is part of a window opening. It will be appreciated that the fasteners 28 may be arranged in the inverse orientation, to extend downwards from within the hollow region to extend out of the header 12, such as when the header 12 is arranged adjacent to a door frame, as shown in FIG. 7. It will also be appreciated that drill point type fasteners 28 are appropriate, allowing each fastener 28 to penetrate the header 12 and the tab 34 of the bracket 10.

In the illustrated embodiment, the header 12 has opposed upper and lower sides 104, 108. The upper side 104 defines an elongate slit 110 along its length. Best shown in FIG. 5, the slit 110 is dimensioned to be equal to, or greater than, the opening 26 of the bracket 10. This allows access through the opening 26 to the bottom side 20 of the bracket 10 to allow securing the fasteners 28 through the bottom side 20 of the bracket 10 and through the lower side 108 of the header 12.

Figure 6:
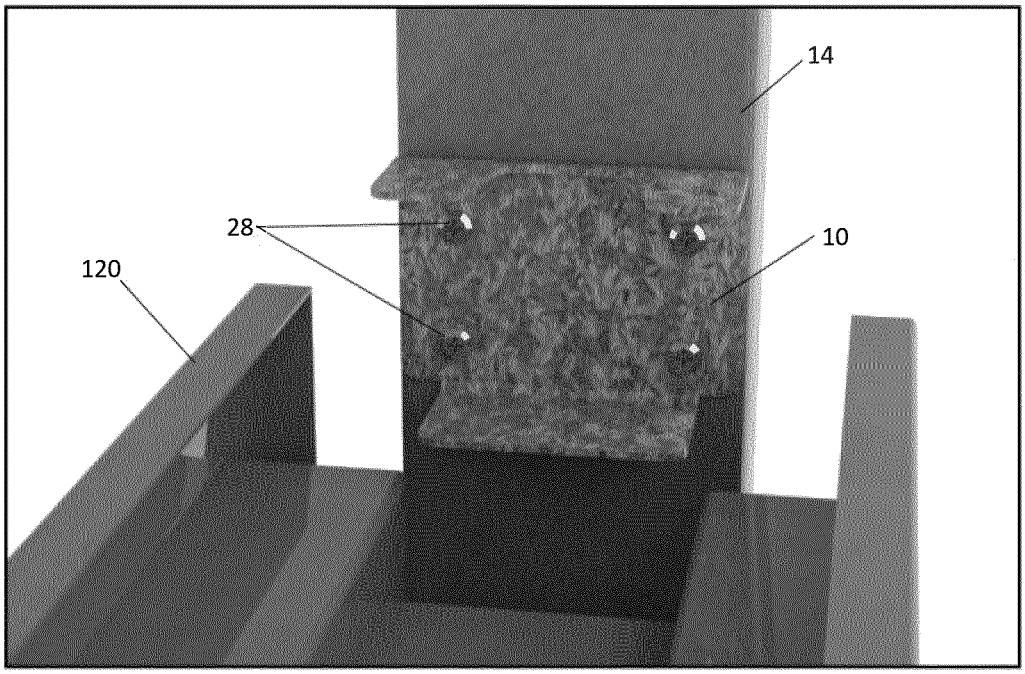
FIGS. 6 to 8 are each perspective views illustrating assembling the assembly shown in the previous figure above a prefabricated door frame.
Figure 8:
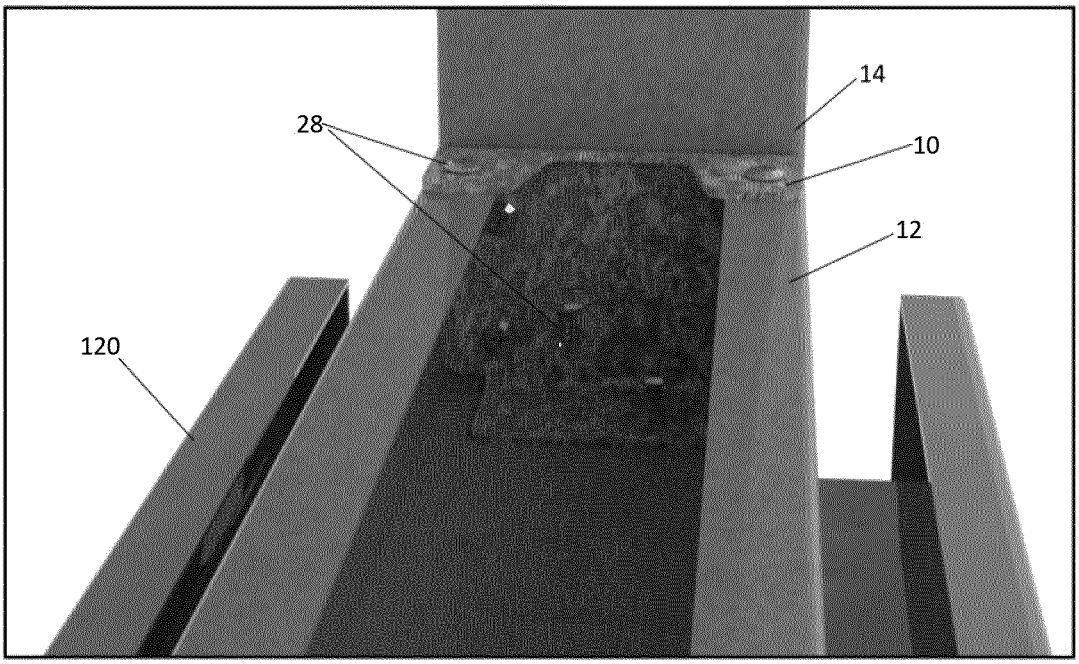

FIGS. 6 to 8 illustrate assembling the assembly 100 adjacent a prefabricated doorframe 120. In practice, the doorframe 120 is typically installed to, or adjacent, a wall frame before the header 12 is secured between studs 14 and above the doorframe 120.

FIG. 6 shows the bracket 10 spaced above the doorframe 120 and mounted to the stud 14 by four fasteners 28. FIG. 7 shows the header 12 placed between the bracket 10 and the doorframe. FIG. 8 shows fasteners 28 secured through the top side 18 of the bracket 10 and upper side 104 of the header 12, and fasteners 28 being secured through the bottom side 20 of the bracket 10 and lower side 108 of the header 12 from within the hollow internal region of the header 12.

The configuration of the disclosed bracket 10 enhances access during installation by allowing access through the opening 26 and to the bottom side 20 of the bracket 10. This allows a user to secure fasteners 28 through the bracket 10 and into the header 12 from within the internal hollow region of the header 12. This is particularly useful when assembling the header 12 to a stud 14 where access to an underside of the header 12 is limited or prevented, such as when a doorframe 120 is already in place in a doorway opening of a wall frame.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

The invention claimed is:

1. A wall framing bracket for securing a header perpendicularly to a stud, the bracket including:

a planar back-plate configured to be secured to the stud; and opposing top and bottom sides extending from the back-plate, the sides spaced apart to allow arranging against, and fixing to, opposed surfaces of the header, wherein the bottom side is planar and defines a width dimensioned to be less than or equal to a width defined by the back-plate, and wherein the top side defines an opening to allow access to the bottom side to secure one or more fasteners therethrough and into the header and said top side defines a width dimensioned to be equal to the width defined by the back-plate.

2. The wall framing bracket according to claim 1, wherein the opening is defined between a pair of spaced tabs.

3. The wall framing bracket according to claim 1, wherein the back-plate defines a plurality of apertures, each aperture configured to receive a fastener to allow securing the bracket to the stud.

4. The wall framing bracket according to claim 3, wherein at least one of the sides defines a further plurality of apertures, each further aperture configured to receive a fastener to allow securing the bracket to the header.

5. The wall framing bracket according to claim 1, wherein the width defined by the back-plate is dimensioned to be substantially equal to a width defined by the stud.

6. A wall framing assembly including:

a stud;

a bracket according to claim 1; and a header having opposed sides and defining an elongate slit extending along a length of one of the sides, the slit dimensioned to be equal to, or greater than, the opening of the bracket to allow access through the opening.

7. The wall framing bracket according to claim 2, wherein the back-plate defines a plurality of apertures, each aperture configured to receive a fastener to allow securing the bracket to the stud.

8. The wall framing bracket according to claim 7, wherein at least one of the sides defines a further plurality of apertures, each further aperture configured to receive a fastener to allow securing the bracket to the header.

9. The wall framing bracket according to claim 8, wherein the side accessible through the opening defines a width dimensioned to be less than a width defined by the back-plate.

10. The wall framing bracket according to claim 7, wherein the side accessible through the opening defines a width dimensioned to be less than a width defined by the back-plate.

11. The wall framing bracket according to claim 4, wherein the side accessible through the opening defines a width dimensioned to be less than a width defined by the back-plate.

12. The wall framing bracket according to claim 3, wherein the side accessible through the opening defines a width dimensioned to be less than a width defined by the back-plate.

13. The wall framing bracket according to claim 2, wherein the side accessible through the opening defines a width dimensioned to be less than a width defined by the back-plate.

14. The wall framing bracket according to claim 9, wherein the width defined by the back-plate is dimensioned to be substantially equal to a width defined by the stud.

15. The wall framing bracket according to claim 10, wherein the width defined by the back-plate is dimensioned to be substantially equal to a width defined by the stud.

16. The wall framing bracket according to claim 11, wherein the width defined by the back-plate is dimensioned to be substantially equal to a width defined by the stud.

17. The wall framing bracket according to claim 12, wherein the width defined by the back-plate is dimensioned to be substantially equal to a width defined by the stud.

18. The wall framing bracket according to claim 13, wherein the width defined by the back-plate is dimensioned to be substantially equal to a width defined by the stud.

* * * * *